United States Patent [19]

McCrainor et al.

[11] 3,934,639

[45] Jan. 27, 1976

[54] METHOD OF MARKING AN INGOT

[75] Inventors: Peter Richard McCrainor; Bryan William Edwards, both of Birmingham, England

[73] Assignee: Foseco International Limited, Birmingham, England

[22] Filed: Apr. 4, 1974

[21] Appl. No.: 458,039

[30] Foreign Application Priority Data

May 9, 1973 United Kingdom ..... 22156/73

[52] U.S. Cl. ..... 164/100; 249/103

[51] Int. Cl.[2] ..... B41B 11/62; B22D 19/00

[58] Field of Search ..... 249/103, 104; 164/97, 236, 164/246, 34 US, 35 US, 91, 103, 104, 105; 75/204; 29/182.1, 182.7, 182.8

[56] References Cited

UNITED STATES PATENTS

| | | | |
|---|---|---|---|
| 2,330,277 | 9/1943 | Fritschle | 249/103 X |
| 3,189,958 | 6/1965 | Newbold | 164/133 |
| 3,314,116 | 4/1967 | Wittmoser et al. | 164/246 UX |
| 3,450,189 | 6/1969 | MacDonald | 164/97 UX |
| 3,534,440 | 10/1970 | Roberts | 249/103 X |

FOREIGN PATENTS OR APPLICATIONS

| | | | |
|---|---|---|---|
| 661,953 | 3/1929 | France | 249/103 |

*Primary Examiner*—Ronald J. Shore
*Assistant Examiner*—John E. Roethel
*Attorney, Agent, or Firm*—Cushman, Darby & Cushman

[57] ABSTRACT

Ingots are marked by locating on a face of the ingot mould prior to casting, an indicium or indicia defining body formed of bonded particulate refractory supported on an organic foam base, e.g. polyurethane foam.

10 Claims, No Drawings

METHOD OF MARKING AN INGOT

This invention relates to ingot marking.

In the past, hot ingots have been marked by means of marking pencils comprising a refractory pigment in a suitable vehicle. Pencil marks made in this way have a disadvantage in that they are not very permanent: surface flaking or scaling, abrasion, high temperatures or chemical attack all cause disappearance of the mark. A further disadvantage of using marking pencils is that the ingots can only be marked after stripping from the ingot mould. Accordingly, it is necessary to operate a check on the moulds between teeming and stripping.

It has been suggested to provide permanent markings on ingot moulds themselves. This is also disadvantageous, however, since although the marking can be successfully transferred to the cast ingot, problems of stripping the ingot may arise and in any case, since the same ingot mould may be used for casting different types and grades of metal, confusion is still possible.

It has also been suggested to provide markings in the form of indicia cut into insulating slabs or tiles which are affixed to the ingot mould's inside wall. After the ingot has been removed from the mould and the insulating slab residues have fallen away, the markings are seen to be embossed in the ingot surface. However, this method is more appropriate for ingots which are to be kept in stock for rolling at a later date. When the ingot is reheated for rolling immediately after it has been removed from the ingot mould the markings produced on the ingot may be difficult to decipher due to scaling losses. In a modification of this method the refractory material of which the slabs or tiles are made is designed to be cast into and remain embedded in the ingot surface thus providing a contrasting marking. However, this method also has disadvantages since when the packing density of simple bonded refractory materials is low enough to permit easy crushing during rolling the materials are fragile and difficult to handle. This is particularly severe in the case of complex shapes such as indicia and makes them difficult to affix. On the other hand if the simple bonded refractory materials are dense and hard they cause roller damage.

According to the present invention there is provided a method of marking an ingot which comprises locating on one or more faces of the cavity of an ingot mould one or more shaped bodies defining indicia and formed of a material comprising particulate refractory material bonded with a refractory binder and supported on a foam plastics substrate, and casting molten metal into the ingot mould to form an ingot.

Suitable particulate refractory materials include alumina, silica, zirconia, zirconium silicate, mullite and calcined high alumina fireclay, each of these being used alone or in admixture with others. Suitable refractory binders are aluminium hydrogen orthophosphate, aluminium hydroxychloride, aluminium chlorophosphate hydrate and silica and alumina hydrosols. A specific system of value is calcined alumina bonded with aluminum hydrogen orthophosphate. aluminium Any foam plastics having communicating pores may be used as the substrate supporting the bonded particulate refractory material. Suitable plastics include polyethylene, polypropylene, rubber latex, polyester polyurethane and polyether polyurethane. Flexible polyurethane foams are preferred.

To make the shaped indicia-defining bodies, the particulate refractory, the refractory binder and other substances acting as process aids, such as a liquid vehicle, suspension agent, dispersing agent and in some cases an organic binder, are made up into a slurry which is then used to impregnate pieces of plastics foam. Preferably the foam is cut out into the foam of the desired identifying mark, character or symbol before impregnation. Surplus slurry is then squeezed out and the impregnated foam pieces then dried, preferably by microwave heating since this avoids the distortion of the impregnated foam shapes which is commonly caused by hot air drying.

The resulting bodies are very tough and well adapted to withstand handling, accidental impact and nailing into place; they require no special packaging for transportation provided they are kept dry.

The bodies comprising identifying marks, characters or symbols thus made are nailed or otherwise fixed into place within the ingot mould. As the ingot is cast, the heat of the molten metal serves both to burn out the organic foam and to promote the formation of a refractory bond, converting the constitution of the shaped body to a highly porous cellular refractory material which closely replicates the physical structure of the original organic foam. After stripping the ingot from the mould and reheating in the soaking-pit, and after the first few passes of the ingot through the rolling mill, it can be seen that this material contrasts visibly with the surrounding metal of the ingot surface. During subsequent rolling operations, however, the marking is readily crushed to form a coherent powder which continues to provide a similar contrast, generally up to at least the fifteenth rolling pass, while not causing damage to the rollers.

The shaped indicia-defining bodies may be located anywhere desired at the side of the mould cavity, e.g. on the mould walls, on the walls of a head box, or on a hot top lining in the mould. If a refractory heat-insulating hot top lining is used, it is preferred to affix the body or bodies thereto, e.g. by adhesive, staples, nails, clips or the like. Alternatively the body or bodies may be affixed to a support, e.g. a metal sheet or a sheet of refractory material, and the support in turn affixed to the ingot mould or head box.

The exact shape of the body may vary widely. The body may be formed as an indicium itself, e.g. a letter or figure, or it may be a shape, e.g. rectangular, constituting a frame defining a figure or letter. The body may be mounted on a refractory substrate, preferably of standard shape and size and the substrate fitted into a suitable recess in the refractory heat-insulating lining if desired.

The positioning of the bodies is important since they must be located in such a way that the identifying marks on the ingot may be read easily, usually from the "pulpit" of the rolling mill. It is also preferably that the bodies are located such that the identifying marks are approximately one third of the distance across the ingot face in order to avoid the high degree of distortion which can occur at the corners during rolling, and to avoid the risk of damage by the crane tongs which grip the ingot across the centres of the faces as the ingot is lifted into and out of the soaking pit.

When the bodies are affixed to hot top linings it is important that the linings fit sufficiently closely to the ingot mould wall to prevent molten metal penetrating behind the lining otherwise the metal which has penetrated may survive oxidation in the soaking pit, and obscure the identifying marks on the ingot during subsequent rolling.

The following example is illustrative of the invention.

EXAMPLE

A slurry was prepared according to the following receipe by combining the ingredients with a high-speed stirrer:

59% by weight calcined alumina, particle size range 0.004mm to 0.01mm.

4% by weight kaolin

11% by weight of a 40% w/w aqueous aluminium hydrogen orthophosphate solution

8% by weight of a 2% w/w aqueous sodium hexamethaphosphate solution

18% by weight water

The desired identification symbols were cut 18mm thick from a cellular polyurethane foam having a cell count of 8 – 10 cells per linear cm and squeezed under the surface of the slurry until as much air as possible had been expelled, then allowed to remain beneath the slurry surface until they had regained their original dimensions.

The slurry-laden pieces of foam were then removed from the slurry and squeezed between two similar pieces of foam in order to expel excess slurry. This squeezing process was so adjusted as to result in a final dried product of density 0.75 to 1.0 gm/cc.

The pieces of foam were then laid on a surface of shape corresponding to that of the surface within the ingot mould assembly to which they were eventually to be fastened, and dried in a microwave oven.

The refractory/organic foam symbols thus formed were nailed into place on the molten metal contacting surface of a hot top insulating board already installed in an ingot mould. Molten metal was then cast in the ingot mould and allowed to solidify.

When the ingot was stripped from the mould, the ashes of the hot top insulating board remained in position on the ingot, hence at that stage it was not possible to see the symbols. However, after the ingot had been heated in a soaking pit and after about the second rolling pass on the ingot face bearing the symbols, the symbols became clearly visible, appearing black against the glowing red surface of the ingot being rolled, and remained so until the twenty-fifth rolling pass, after which they became elongated to a degree which made them difficult to decipher. No damage to the mill rollers had resulted.

We claim as our invention:

1. In the method of marking an ingot the improvement which comprises locating on at least one face of the cavity of an ingot mould at least one shaped body defining indicia and formed of a material comprising a foam plastics substrate supporting within its structure particulate refractory material bonded with a refractory binder, and casting molten metal into the ingot mould to form an ingot.

2. The method of claim 1 wherein the refractory material is selected from the class consisting of alumina, silica, zirconia, zirconium silicate, mullite and calcined high-alumina fire-clay.

3. The method of claim 1 wherein the binder is selected from the class consisting of aluminium hydrogen orthophosphate, aluminium hydroxychloride, aluminium chlorophosphate hydrate, silica hydrosol and alumina hydrosol.

4. The method of claim 1 wherein the substrate is selected from the class consisting of polyethylene, polypropylene, rubber latex and polyurethane foams.

5. The method of claim 1 wherein at least one body consists essentially of calcined alumina bonded with aluminium hydrogen orthophosphate and supported on polyurethane foam.

6. The method of claim 1 wherein at least one body of material is located against a hot top lining slab in the upper portion of the mould cavity.

7. In the method of marking an ingot, the improvement which comprises locating on at least one face of the cavity of an ingot mould at least one shaped body defining indicia and formed of a material consisting essentially of particulate refractory material bonded with a refractory binder and supported on a foam plastics substrate, and casting molten metal into the ingot mould to form an ingot, wherein the refractory material is selected from the class consisting of alumina, silica, zirconia, zirconium silicate, mullite and calcined high-alumina fire-clay.

8. In the method of marking an ingot, the improvement which comprises locating on at least one face of the cavity of an ingot mould at least one shaped body defining indicia and formed of a material consisting essentially of particulate refractory material bonded with a refractory binder and supported on a foam plastics substrate, and casting molten metal into the ingot mould to form an ingot, wherein at least one body consists essentially of calcined alumina bonded with aluminium hydrogen orthosphosphate and supported on polyurethane foam.

9. In the method of marking an ingot, the improvement which comprises locating on at least one face of the cavity of an ingot mould at least one shaped body defining indicia and formed of a material consisting essentially of particulate refractory material bonded with a refractory binder and supported on a foam plastics substrate, and casting molten metal into the ingot mould to form an ingot, wherein at least one body of material is located against a hot top lining slab in the upper portion of the mould cavity.

10. In the method of marking an ingot the improvement comprising the steps of:

impregnating a shaped body defining indicia comprised of a foam plastics substrate with a particulate refractory material bonded with a refractory binder;

drying the impregnated foam plastics substrate; securing said substrate within an ingot mould; and casting molten metal into the ingot mould to form an ingot having the predetermined indicia formed therein.

* * * * *